United States Patent [19]

Frye et al.

[11] 4,405,126

[45] Sep. 20, 1983

[54] AIR REJECT GATE

[75] Inventors: Kenneth G. Frye, South Egremont; Donald R. Grody, Pittsfield; Gerald A. Guild, Dalton, all of Mass.

[73] Assignee: Beloit Corporation, Beloit, Wis.

[21] Appl. No.: 228,260

[22] Filed: Jan. 26, 1981

[51] Int. Cl.[3] ..... B65H 29/62

[52] U.S. Cl. ..... 271/279; 198/366; 198/438; 209/639; 209/644; 271/195

[58] Field of Search ..... 271/279, 300, 195, 177, 271/309; 83/98, 99, 105, 107; 209/639, 644, 906; 198/366, 367, 438

[56] References Cited

U.S. PATENT DOCUMENTS

| | | | |
|---|---|---|---|
| 3,323,645 | 6/1967 | Hori et al. | 271/177 X |
| 3,363,520 | 1/1968 | Obenshain . | |
| 3,941,370 | 3/1976 | Martin et al. | 271/195 X |
| 3,993,358 | 11/1976 | Volat et al. | 271/279 X |
| 4,062,536 | 12/1977 | Michelson | 271/195 X |

FOREIGN PATENT DOCUMENTS

| | | | |
|---|---|---|---|
| 2508700 | 9/1976 | Fed. Rep. of Germany | 271/279 |

*Primary Examiner*—Bruce H. Stoner, Jr.
*Attorney, Agent, or Firm*—Hill, Van Santen, Steadman & Simpson

[57] ABSTRACT

A gate station incorporates air pressure flows to direct clips in a production stream through the station and to selectively divert defective clips into a separate reject steam. Mounted on a support plate in the station are an upstream manifold, continuously supplied with low pressure air, and a downstream manifold, having a plurality of downwardly directed air ports and selectively supplied with high pressure air. Air flow from the upstream manifold is directed laterally over the upper surface of a clip so as to enable atmospheric pressure to maintain the clip travelling through the gate station in the production stream. If a clip is to be diverted, the downstream manifold is injected with high pressure air causing blasts of high velocity air through the downwardly directed ports. This high velocity air disrupts the flow from the upstream manifold and forces the leading edge of the defective clip downwards, pressing the clip into the reject stream.

5 Claims, 4 Drawing Figures

AIR REJECT GATE

BACKGROUND OF THE INVENTION

1. Field of the Invention

The invention relates to means for selectively diverting preselected clips out of a sheet material flow stream.

2. The Prior Art

In a sheet material flow stream, sequential clips of paper or other sheet material are inspected for defects or damage whereupon such defective clips may be selectively diverted out of the stream at a reject gate station. The defective clips may be directed to a reject chute for disposal or recycling; whereas the satisfactory clips continue on in the stream for further processing and packaging. Various mechanical gate devices have been devised for deflecting clips into a reject chute.

The mechanical gates, however, are prone to jam-up. In some cases, when sheeting webs are run at high speed, the mechanical gates are unable to react fast enough to remove a single defective clip. Another desirable feature often lacking in mechanical reject gates is the ability to ready the gate in either open or closed positions during passage of a clip preceding the clip to be diverted without damaging or marking the passing sheet material.

The present invention overcomes these and other drawbacks inherent to mechanical gates by providing for an extremely quick-acting gate system having no moving parts subject to wear or which can mark or damage sheet material.

SUMMARY OF THE INVENTION

The invention comprises a reject gate which incorporates fluid flow control for permitting ongoing passage of sheet material clips through a gate station along a first or main stream and for deflecting other clips passing into the gate station into a second stream. The fluid gate system comprises two pressure air manifolds consecutively arranged along and above the first stream in the gate station. The manifold have air flow discharge ducts extending transversely across the first stream for directing pressure against clips passing along the first stream. The upstream manifold directs a continuous flow of low pressure air laterally across the top of each clip, causing atmospheric air pressure to maintain the clip in the first stream. The downstream manifold directs bursts of high pressure air against the leading edge of any preselected clip passing through the gate station in response to a pressure supply valve for deflecting these clips into the second stream.

DESCRIPTION OF THE PREFERRED EMBODIMENTS

Figure 1:
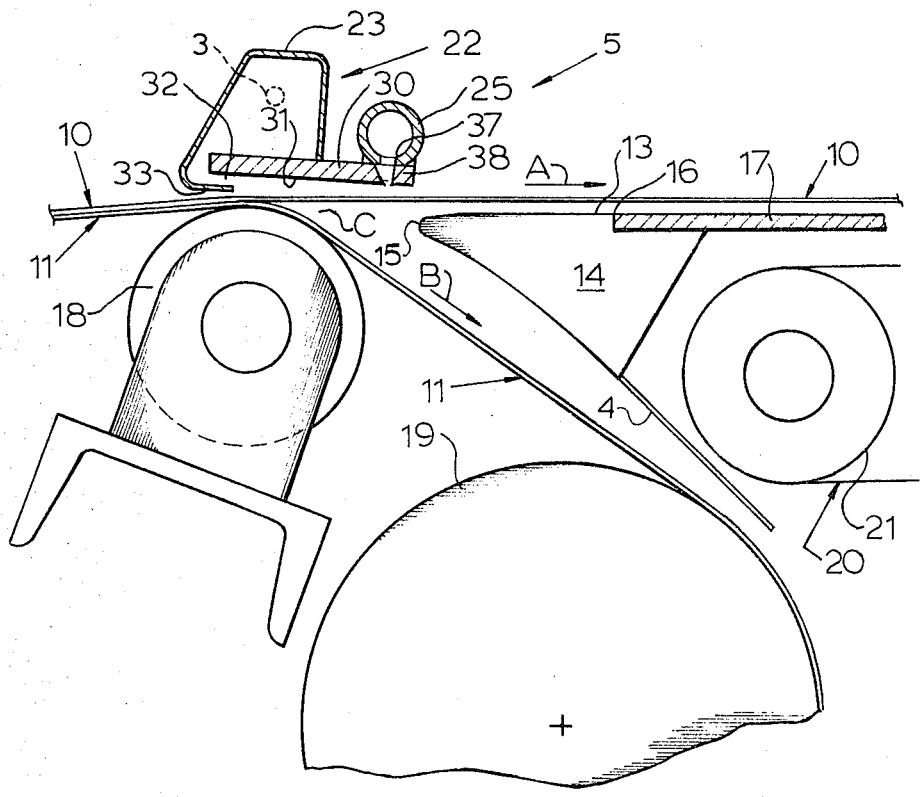
FIG. 1 is a diagrammatic side cross-sectional view of an air reject gate according to the present invention.

A clip is a set of uniformly stacked sheets which have been severed from the leading ends of travelling webs of paper by a severing device. As part of an overall system to convert webs of paper into sheets and package the sheets in predetermined piles, clips of paper pass through a gate station 5 shown in FIGS. 1 and 2. For purposes of the preferred embodiment, the gate station 5 here described serves to divert defective clips out of the main sheet material flow stream and toward a reject chute. However, the present invention is not limited to such use but may, for example, function to deflect clips already deemed satisfactory to alternate discharge points in a two point discharge sheeter arrangement. The present invention may also be used to deflect certain ones of a flow of single sheets.

Figure 2:
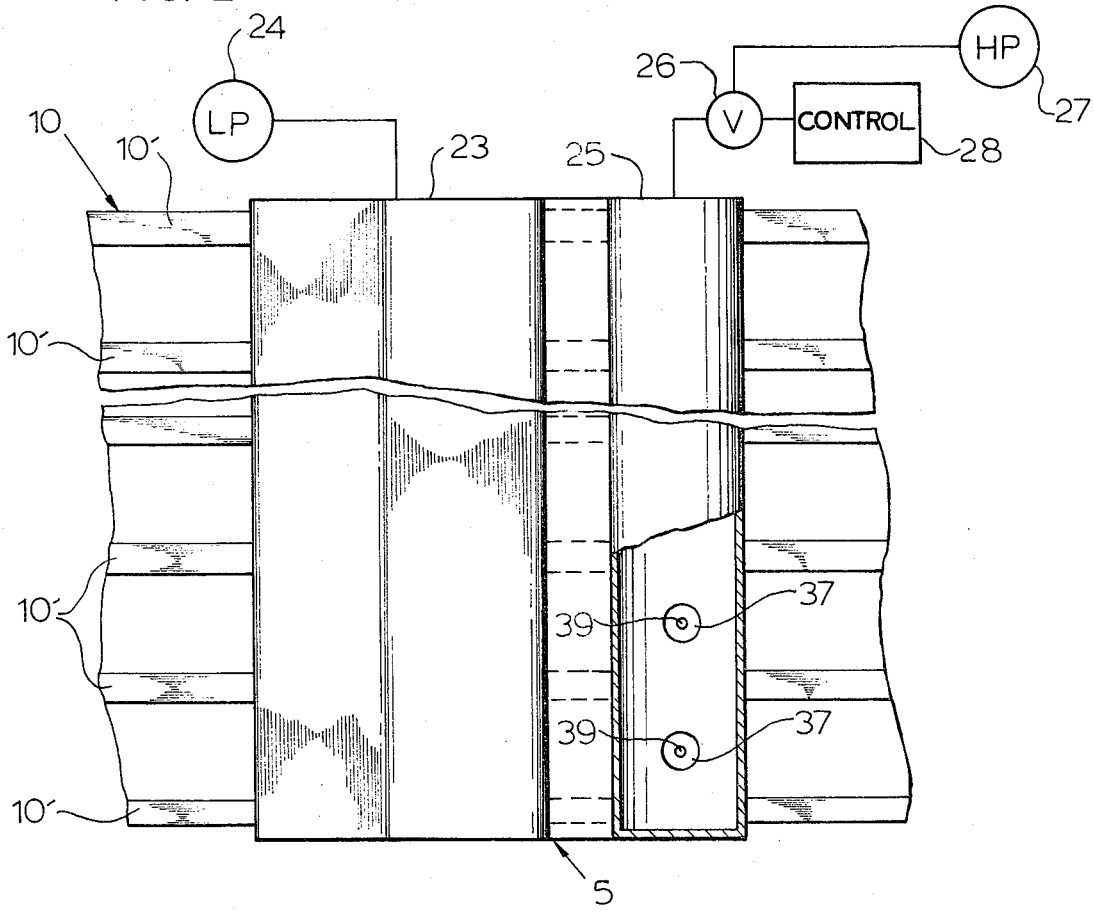
FIG. 2 is a diagrammatic top elevational view, partly broken away, of the air reject gate of FIG. 1.

Upper and lower transport tapes 10 and 11 serve to carry clips therebetween enroute to the gate station. The tapes each comprise a series of laterally spaced belts. Each belt is correspondingly paired with and faces a belt in another tape. Accordingly, as illustrated in FIG. 2, the upper tape belts 10' directly overlie the lower tape belts.

In the gate station, the top transport tape 10 generally maintains a transverse line for the transport of satisfactory clips to downstream processing and packaging. Subsequent in the gate station, the tape 10 passes over the planar upper surface 13 of a stationary platform 14. The platform has an upstream leading edge 15, which is tapered downwardly at its leading edge to assure transfer of the clip onto the planar surface 13. The platform 14 is contiguous at the downstream edge 16 of its upper surface with a planar travel surface 17 over which clips may be transported. In this manner, the upper tape 10 serves to define a first flow stream A from the gate station.

Upstream from the platform leading edge 15, the lower transport tape 11 passes out of parallel with the upper tape 10 and turns downward about a roll 18. The tape 11 passes about a pulley 19 thereby defining a second or branch-off flow path B along which deflected clips are directed downwardly to a reject chute or processing station (not shown). Resilient guide plate means 4 connected at a lower edge of the platform 14 direct clips along the tape 11 in the direction of the flow stream B. Located adjacent the resilient guide plate 4 is a roll 21 which turns clockwise for passing a tape 20 thereabout. The tape 20 serves as a slow speed transport tape for the clips downstream of the gate 5.

Between the roll 18 and the platform edge 15, there is defined an open space C in the gate station. The leading edges of clips passing in stream A are without mechanical support from below during passage through the gate station in accordance with the present invention as described below.

Positioned generally above the open space C in the gate station is a gate control mechanism 22 which directs fluid pressure flows for allowing satisfactory or desired clips to continue on in stream A through the gate station and diverting defective clips downward along stream B toward the reject chute or further station. The control mechanism 22 comprises a first, upstream air manifold 23 continuously connected to a supply of relatively low pressure air 24 and a second, downstream air manifold 25 intermittently connected through a on-off valve means 26 with a supply of relatively high pressure air 27. The valve 26 may be opened and closed in response to a control signal from a control means 28 which may be operated manually or automatically in response to a determination of defectiveness or other criteria for deflection in a manner known in the art. The first and second manifolds are mounted longitudinally upon a stationary support block 30 which extends transversely across the top transport tape 10 in the gate station and overlies the same. The block 30 is rectangular in cross-section. Its bottom surface 31 is angled relative to the top tape 10 such that the upstream end of the block is further from the tape 10 than the downstream end.

The entire assembly of block and manifolds is mounted for pivotable movement about a pivot bar 3 extending through the low pressure manifold 23. Accordingly, the manifold assembly can be rotated out of the gate area so that wrinkled sheets can be manually directed into the reject zone space C during thread-up.

Figure 3:
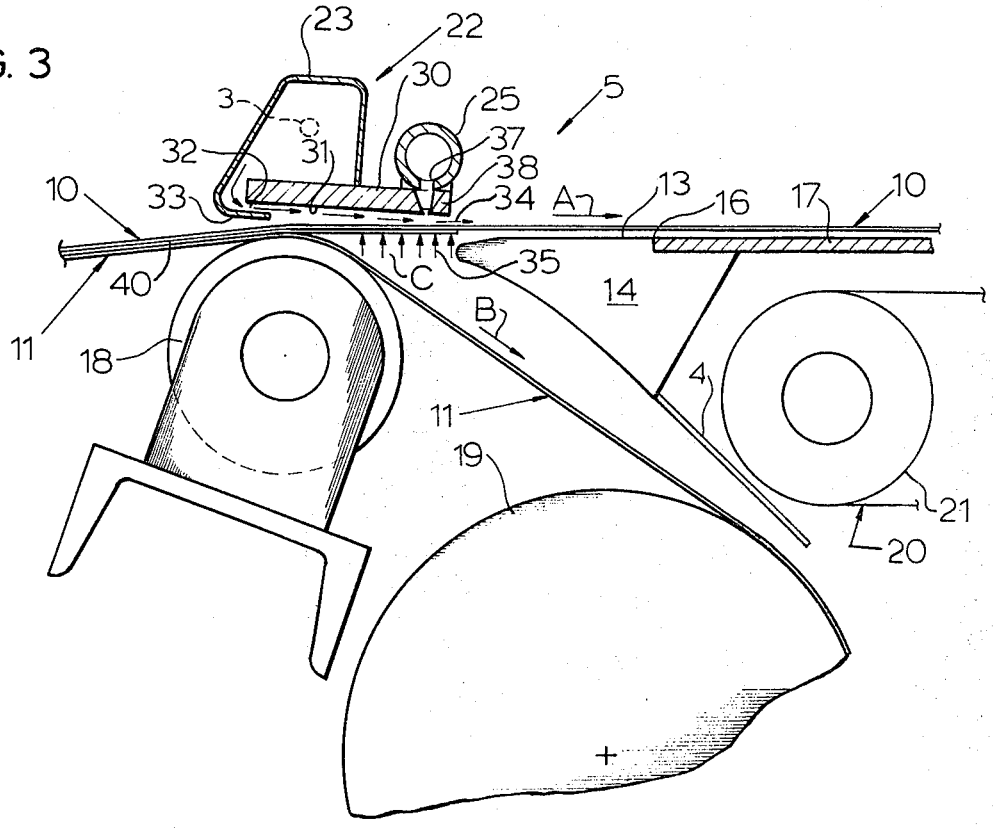
FIG. 3 is a diagrammatic side cross-sectional view of the air reject gate of FIG. 1 during passage of a clip through the gate station along the first stream.

The manifold 23 is formed at its lower ends with a continuous, transverse discharge opening 32 defined between a bottom wall 33 of the manifold housing and the bottom surface 31 of a support plate 30. The discharge opening 32 serves to deliver a generally lateral parallel flow of air over the exposed upper face surfaces between adjacent belts 10' of the top tape 10 as a clip passes into and through the gate station. As illustrated in FIG. 3, this lateral flow of air 34 reduces the static pressure above the leading end of a clip 40 due to its velocity, causing a lower pressure than atmospheric air. Accordingly, atmospheric air pressure forces the clip in the direction of arrows 35 against the top transport tape 10. In this manner, a satisfactory clip 40 is propelled across the open space C in the gate station and passed onto the upper surface 13 of the platform whereupon the top tape 10 propels the clip downstream for further processing and packaging.

The second manifold 25 is formed with a series of bottom surface openings 37 extending in a longitudinal line therein. The manifold 25 may be weld sealed upon the upper face of the support block 30. Each opening 37 is in fluid communication with a discharge port 38 extending through the block 31 and terminating at its lower end in a hole 39 for directing blasts of high velocity air generally in a normal direction with the top transport tape 10 and the flow of clips in stream A across the space C. The series of holes are spaced between the multiple tape belts 10' so as to engage with upper surface of the leading edge of a sheet material clip. The ports 38 may be tapered as shown such that the holes 39 serve as jet nozzles or instead may be bores of substantially constant cross-sectional area.

Figure 4:
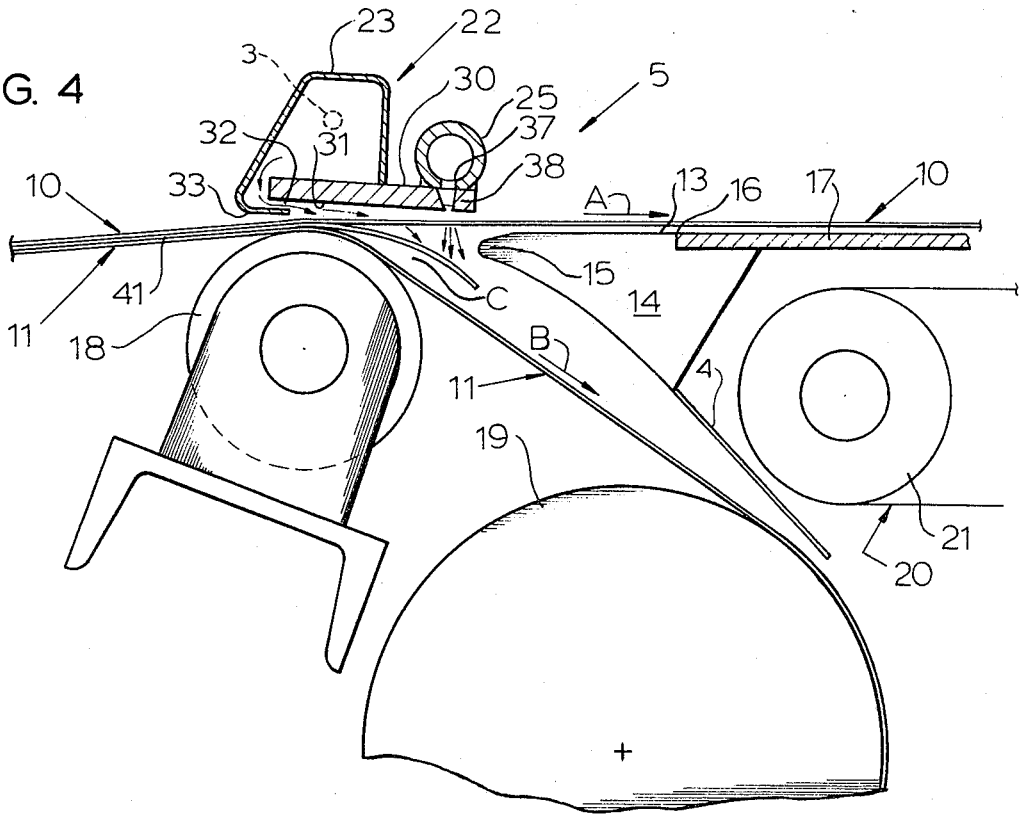
FIG. 4 is a diagrammatic side cross-sectional view of the air reject gate of FIG. 1 upon deflection of a clip into the second stream.

In accordance with the present invention, the blasts of high velocity air are intended to disrupt the flow of air from the first manifold 23 and force the leading edge of a defective clip 41 downwards into stream B as illustrated in FIG. 4. With the leading edge of the clip 41 directed downward, the clip finally settles onto the lower tape 11 whereupon the clip is propelled toward the reject chute (not shown) along flow stream B. It has been found that the perpendicularly directed blasts of air from ports 38 act on the upper surface of the sheets passing immediately thereunder to create a suction force causing the paper to be drawn upwardly toward the surface 31. This suction effect can be deleterious to the desired deflection effect for the downward air blasts. To eliminate this possible suction effect, the downward blasts from ports 38 are preferably timed to precede the leading edge of each clip, forming a curtain-like wall of air for dislodging the clip sufficiently away from the surface 31. Such blast timing can include engagement of the trailing edge of the immediately preceding clip to ensure preceding the leading edge of the subsequent desired deflected clip. The blast continues on as the clip travels further forward beneath the ports 38 to press the clip downward into the stream path B.

As mentioned above, the pressure supply for the first manifold 22 is set lower than the supply for the second manifold 25. High pressure air supplied to the second manifold may be between 15 to 150 psi.

Although various minor modifications may be suggested by those versed in the art, it should be understood that we wish to embody within the scope of the patent warranted hereon all such modifications as reasonably and properly come within the scope of our contribution to the art.

We claim as our invention:

1. A gate apparatus for use in a sheet transfer mechanism in which a seriatim flow of sheets is conducted there-through along a generally lateral main path by virtue of at least upper surface engagement with a laterally running transport tape means, said apparatus comprising:

at least one branch path leading downwardly and away from said main path and defined by a downwardly running transport tape means adapted for undersurface engagement with said sheets, and a control mechanism overlying said main and branch paths for directing each sheet along either said main or said branch paths comprising a first low pressure means for discharging from a first manifold a continuous first fluid flow laterally and parallel across the upper surface of said sheet for causing atmospheric air pressure beneath said sheet to force said sheet upper surface into driving engagement with said laterally running transport tape means and maintain said sheet in said main path and a second high pressure means for intermittently discharging from a second manifold a second fluid flow downwardly against the upper surface of said sheet to deflect said sheet out of driving engagement with said laterally running transport tape means and into said branch path for driving engagement with said downwardly running transport tape means, said first and second manifolds being consecutively disposed on a mounting base with said first manifold upstream of said second manifold, said mounting base being pivotable about a bar extending through said first manifold.

2. The apparatus of claim 1, wherein said second fluid flow begins before the leading edge of the sheet to be deflected passes thereunder and continues on for engagement against the upper surface of the sheet to be deflected.

3. The apparatus of claim 2, wherein said second fluid flow engages initially with the trailing edge of the immediately preceding sheet before engaging with the upper surface of the sheet to be deflected.

4. The apparatus of claim 1, wherein the velocity of said second fluid flow is greater than said first fluid flow velocity.

5. The apparatus of claim 1, wherein the sheets are in the form of clips.

* * * * *